US008408825B2

(12) United States Patent
Gocho

(10) Patent No.: US 8,408,825 B2
(45) Date of Patent: Apr. 2, 2013

(54) APPARATUS AND METHOD TO AVOID CUTTING A SPLICED RECORDING MEDIUM POSITION

(75) Inventor: Tomoko Gocho, Tokyo (JP)

(73) Assignee: Olympus Corporation, Tokyo (JP)

( * ) Notice: Subject to any disclaimer, the term of this patent is extended or adjusted under 35 U.S.C. 154(b) by 634 days.

(21) Appl. No.: 12/643,668

(22) Filed: Dec. 21, 2009

(65) Prior Publication Data

US 2010/0166482 A1 Jul. 1, 2010

(30) Foreign Application Priority Data

Dec. 26, 2008 (JP) ..... 2008-335043

(51) Int. Cl.
*B41J 29/38* (2006.01)
*B41J 11/70* (2006.01)
*B65H 19/18* (2006.01)

(52) U.S. Cl. ..... 400/76; 400/621; 101/226; 242/555

(58) Field of Classification Search ..... 400/621; 83/336; 242/555–556.1; 101/224, 226
See application file for complete search history.

(56) References Cited

U.S. PATENT DOCUMENTS 2,228,300 A * 1/1941 Cohen ..... 83/299
4,128,212 A * 12/1978 Birch ..... 242/523.1
5,899,128 A * 5/1999 Smithe et al. ..... 83/76
8,181,556 B2 * 5/2012 Brandenburg et al. ..... 83/15

FOREIGN PATENT DOCUMENTS

JP 05-270706 A 10/1993
JP 07047622 A * 2/1995

* cited by examiner

*Primary Examiner* — Daniel J Colilla
(74) *Attorney, Agent, or Firm* — Holtz, Holtz, Goodman & Chick, P.C.

(57) ABSTRACT

An image recording apparatus having a carrying unit carrying a continuous recording medium; a recording medium connecting unit for replacing and connecting the continuous recording medium; a cutting unit having cutting means cutting the continuous recording medium and detection means detecting a cutting position of the cutting means; and an introducing unit and having a pair of introducing rotating bodies nipping the continuous recording medium to hold and introduce the continuous recording medium into the cutting unit, and comprising a control unit determining whether a connecting position of the continuous recording medium connected in the recording medium connecting unit corresponds to the cutting position of the cutting unit, and when the connecting position and the cutting position are determined as corresponding, controlling a cutting length of the continuous recording medium having the connecting position, to avoid cutting being conducted at the connecting position.

11 Claims, 11 Drawing Sheets

La+Lb=2Lc

APPARATUS AND METHOD TO AVOID CUTTING A SPLICED RECORDING MEDIUM POSITION

CROSS-REFERENCE TO RELATED APPLICATIONS

This application is based upon and claims the benefit of priority from the prior Japanese Patent Application No. 2008-335043, filed on Dec. 26, 2008, the entire contents of which is incorporated herein by reference.

BACKGROUND OF THE INVENTION

1. Field of the Invention

The present invention relates to an image recording apparatus recording an image by fixing ink on a recording medium such as paper or a film, and a control method of an image recording apparatus.

2. Description of the Related Art

An image recording apparatus that records a color image by discharging an ink on a recording medium (continuous recording medium) that is a winded roll of paper or a film has been known. In such an image recording apparatus, the recording medium with the recorded image is discharged while being cut into respective pages.

In an image recording apparatus that uses the continuous recording medium, when the remaining amount of the recording medium becomes low, for example, the replacing operation of the continuous recording medium is performed by connecting the recording medium with a tape. However, if the splicing position of the continuous recording medium is in the vicinity of the cut position downstream when the continuous recording medium is carried, the tape has to be cut together with the continuous recording medium, which, for example, reduces the life of the cutter, and causes a jamming of the recording medium.

For solving this problem, patent document (Japanese Laid-open Patent Publication No. 5-270706) discloses a technique of controlling the splicing position of a continuous recording medium so as not to place it in the vicinity of the cut position. For example, two rolls of the recording medium are loaded on a roll stand; the old and new rolls of the recording medium are connected with a double-sided tape on the position of the nip roller; and the control is performed with a sensor so that the splicing position of the recording medium is not located in the vicinity of the cut position on the downstream side.

SUMMARY OF THE INVENTION

The present invention has been made in view of the problem described above, and provides an image recording apparatus and a control method of an image recording medium with which the splicing position of the continuous recording medium is controlled so that it is not located in the vicinity of the cut position, to extend the life of the cutter and to prevent the jamming of the recording medium, without using any special recording-medium splicing position control mechanism. Hereinafter, the splicing position is referred to as a connecting position.

In order to achieve the above objective, an image recording apparatus being an aspect of the present invention is an image recording apparatus having a carrying unit carrying a continuous recording medium and having carriage information of the continuous recording medium; a recording medium connecting unit for replacing and connecting the continuous recording medium; a cutting unit having cutting means cutting the continuous recording medium and detection means detecting a cutting position of the cutting means; and an introducing unit disposed between the carrying unit and the cutting unit, and having a pair of introducing rotating bodies nipping the continuous recording medium to hold and introduce the continuous recording medium into the cutting unit, comprising a control unit determining whether a connecting position of the continuous recording medium connected in the recording medium connecting unit corresponds to the cutting position of the cutting unit, and when the connecting position and the cutting position are determined as corresponding, controlling a cutting length of the continuous recording medium having the connecting position, to avoid cutting being conducted at the connecting position.

Meanwhile, a control method of an image recording apparatus being another aspect of the present invention is a control method of an image recording apparatus having a carrying unit carrying a continuous recording medium and having carriage information of the continuous recording medium; a recording medium connecting unit for replacing and connecting the continuous recording medium; a cutting unit having cutting means cutting the continuous recording medium and detection means detecting a cutting position of the cutting means; and an introducing unit disposed between the carrying unit and the cutting unit, and having a pair of introducing rotating bodies nipping the continuous recording medium to hold and introduce the continuous recording medium into the cutting unit, the control method comprising determining whether a connecting position of the continuous recording medium connected in the recording medium connecting unit corresponds to the cutting position of the cutting unit, and when the connecting position and the cutting position are determined as corresponding, performing a control of a cutting length of the continuous recording medium having the connecting position, to avoid cutting being conducted at the connecting position.

DESCRIPTION OF THE PREFERRED EMBODIMENTS

Hereinafter, embodiments of the present invention are described in detail with reference to the drawings. In the following description, as the image recording apparatus of the embodiment, an example of a full-line ink-jet printer apparatus is used for explanation.

Figure 1:
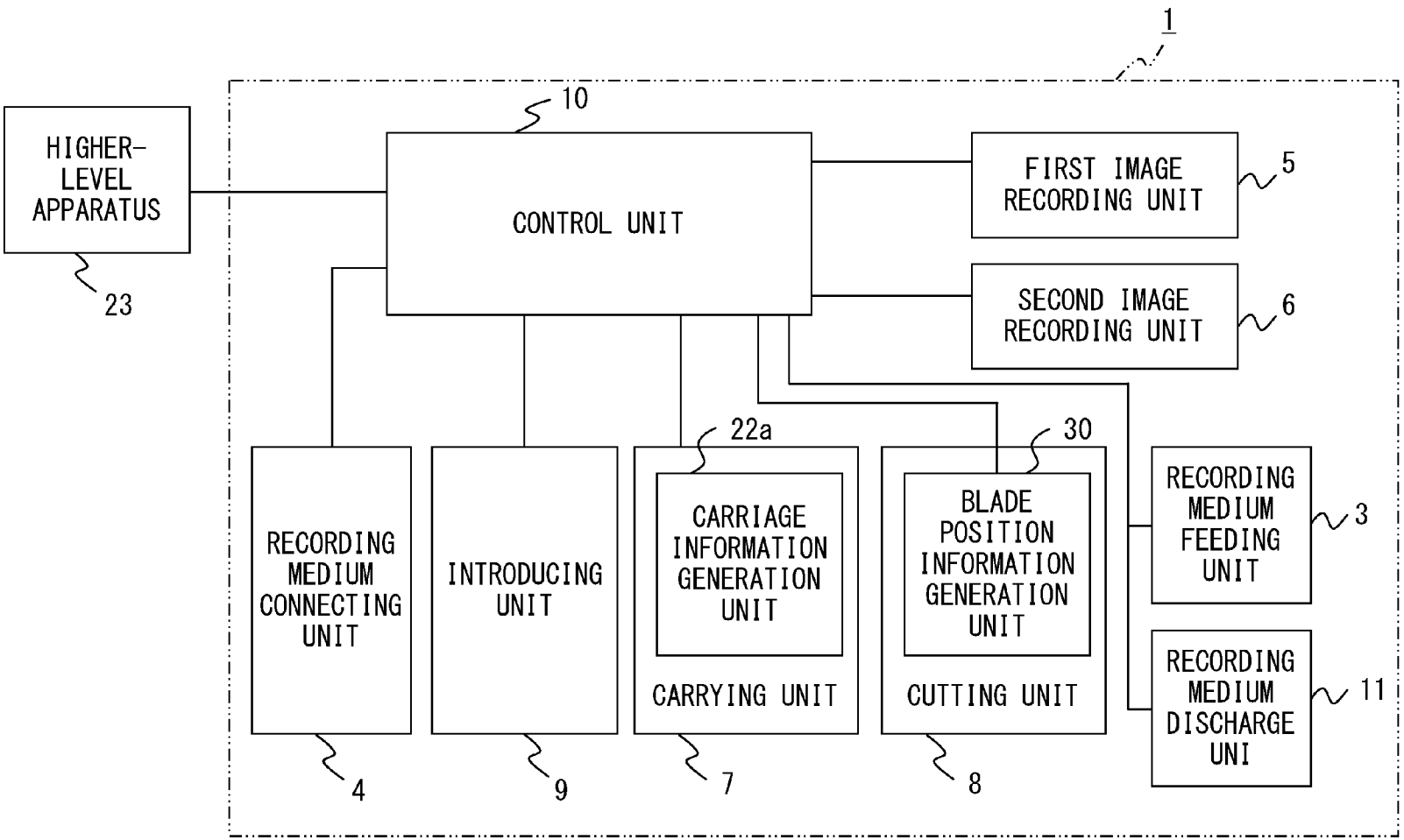
FIG. 1 is a diagram illustrating the overall configuration of an image recording apparatus in an embodiment.
Figure 2:
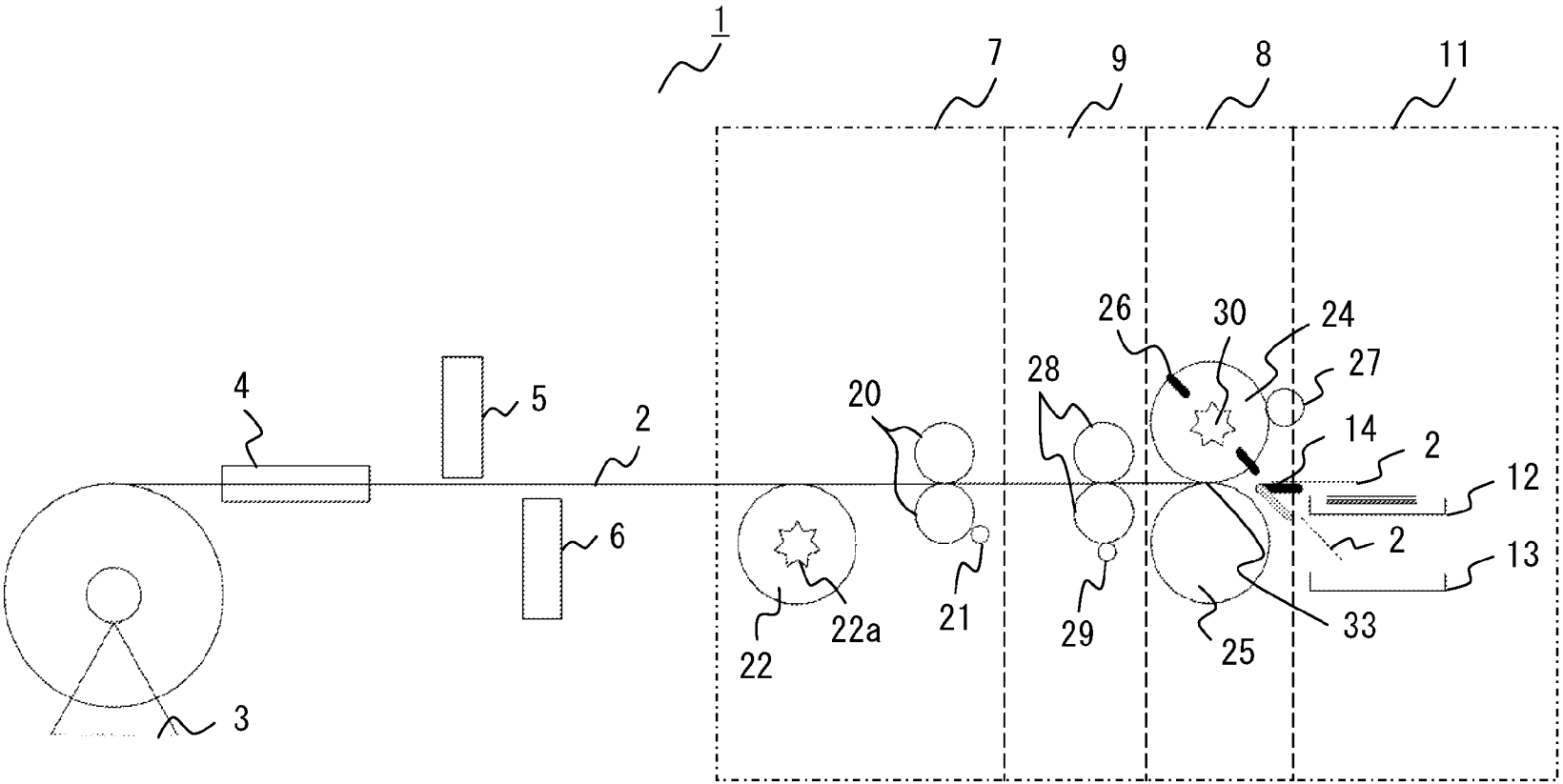
FIG. 2 is a section diagram illustrating the format of the image recording apparatus in the embodiment.

FIG. 1 is a diagram illustrating the overall configuration of the image recording apparatus of an embodiment. FIG. 2 is a section diagram illustrating the format of the image recording apparatus of the embodiment.

In FIG. 1 and FIG. 2, an image recording apparatus 1 is composed of a recording medium feeding unit 3 rolling up a continuous recording medium 2 (hereinafter, simply referred to as a recording medium) that is a continuous roll, a recording medium connecting unit 4 for connecting the recording medium 2, a first image recording unit 5 performing image recording on the front surface of the recording medium 2, a second image recording unit 6 performing image recording on the back surface of the recording medium 2, a carrying unit 7 carrying, at a predetermined tension and speed, the recording medium 2 on which image recording has been performed by the first image recording unit 5 and the second image recording 6, a cutting unit 8 cutting the recording medium 2 to a predetermined length, an introducing unit 9 disposed between the carrying unit 7 and the cutting unit 8, and a control unit 10 controlling the entire apparatus.

Meanwhile, a recording medium discharge unit 11 storing the recording medium 2 that is cut by the cutting unit 8 is disposed on the back of the cutting unit 8. The recording medium discharge unit 11 is equipped with a recording medium stacker 12 storing the recording medium 2 on which an image is recorded, and a discarded medium stacker 13 for discarding unnecessary recording medium 2. In addition, the discharge destination of the recording medium 2 is switched between the stacker 12 and the stacker 13 by a switching plate 14.

Figure 3:
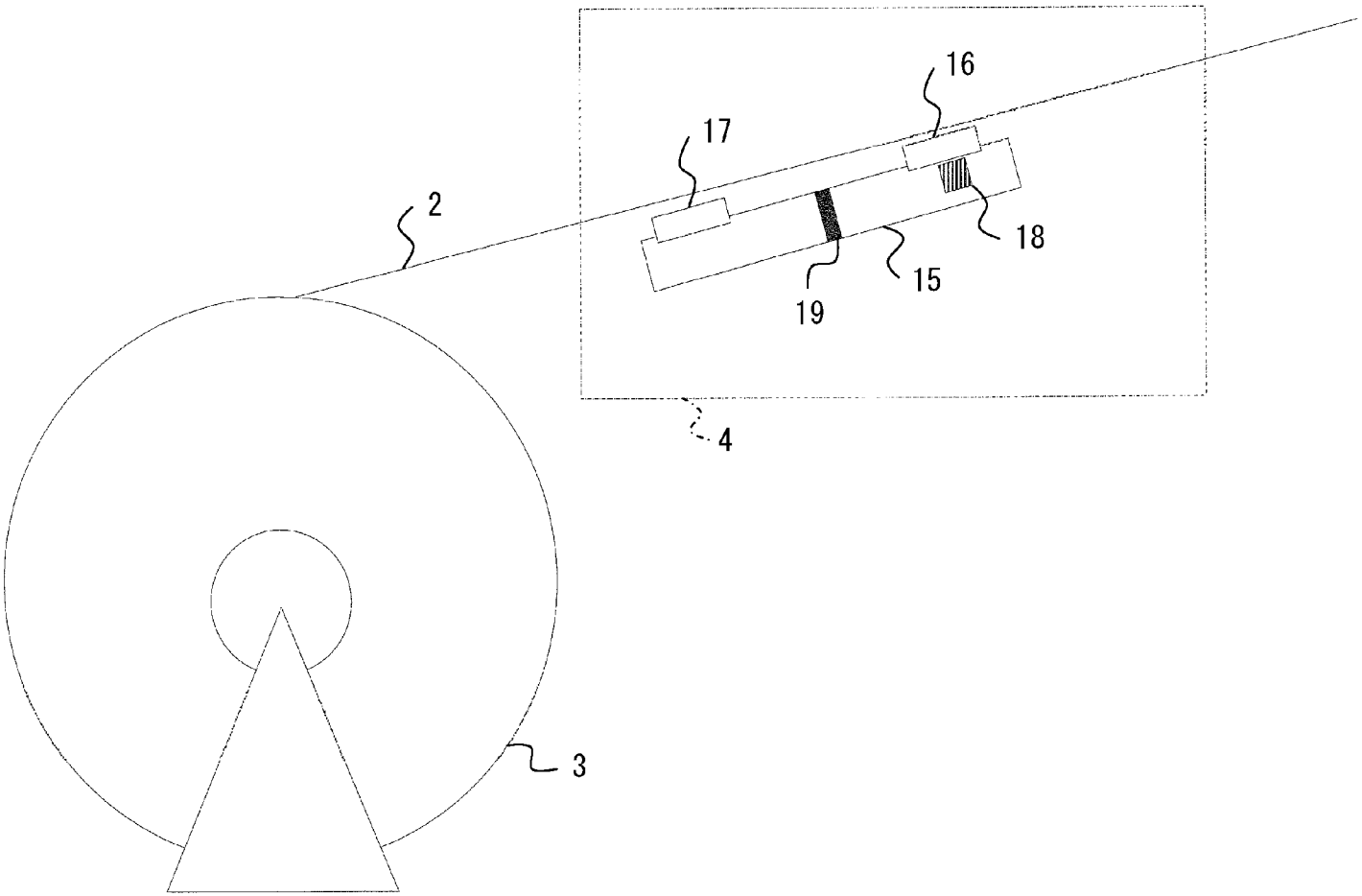
FIG. 3 is a diagram illustrating a recording medium connecting unit, which is an enlarged view of the vicinity of the recording medium connecting unit.
Figure 4:
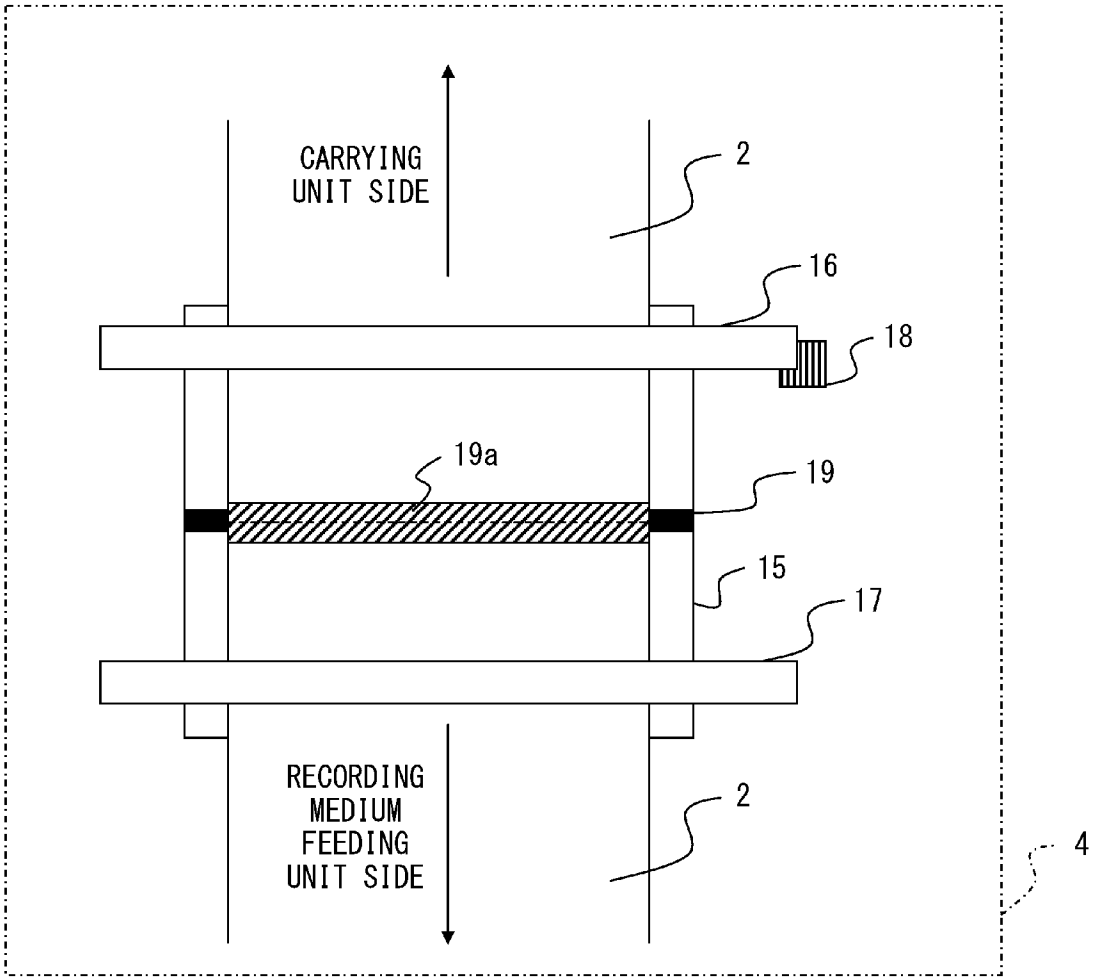
FIG. 4 is a top-view diagram of the recording medium connecting unit.

FIG. 3 and FIG. 4 are diagrams illustrating the recording medium connecting unit 4 described above in detail: FIG. 3 is an enlarged view of the vicinity of the recording medium connecting unit 4, and FIG. 4 is a top-view diagram of the recording medium connecting unit 4. The recording medium 2 is carried on a recording medium mounting plate 15, and when the remaining amount of the recording medium 2 becomes low, the carriage of the recording medium 2 is stopped and a first recording medium fixing mechanism 16 and a second recording medium fixing mechanism 17 are activated, to fix the recording medium 2 on the recording medium mounting plate 15.

Meanwhile, the recording medium mounting plate 15 is equipped with a recording medium fixing mechanism activation sensor 18 for detecting the activation of the first recording medium fixing mechanism 16, and the detection signal from the recording medium fixing mechanism activation sensor 18 is sent to the control unit 10.

In addition, a recording medium cutting slit 19 is disposed on the recording medium mounting plate 15. The recording medium 2 can be cut by inserting a blade such as a cutter, for example, into the recording medium cutting slit 19. After the recording medium 2 is cut, the second recording medium fixing mechanism 17 is released; the roll of the recording medium 2 installed on the recording medium feeding unit 3 is taken out; and a new roll of the recording medium 2 is installed. Then, an end part of the new recording medium 2 is overlapped with the old recording medium 2; the second recording medium fixing mechanism 17 is locked; both the recording media 2 are cut by inserting a cutter blade in the recording medium cutting slit 19; and both the recording media 2 are connected with a tape 19*a* in the state in which there is no gap between the end parts of the new and old recording media 2.

Meanwhile, the carrying unit 7 has a nip roller pair 20 that sandwiches and holds the recording medium 2 and carries the recording medium 2 to the downstream side. The nip roller pair 20 is driven by a nip roller driving motor 21. In addition, the carrying unit 7 has a roller 22 that rotates in accordance with the carriage of the recording medium 2, and the roller 22 has a carriage information generation unit 22*a* that detects the carried amount of the recording medium 2. The carriage information generation unit 22*a* consists of, for example, an encoder.

The cutting unit 8 has a cut roller 24 as a cutting-side rotating body and an anvil roller 25 as a receiving-side rotating body rotating at a predetermined rotation number. The cut roller 24 and the anvil roller 25 are disposed facing each other so as to be able to cut the recording medium 2. The outer-circumference surface of the cut roller 24 is equipped with cutter blades 26, and the cutter blades 26 cut the recording medium 2.

The driving source of the cut roller 24 is a cut roller driving motor 27. The cut roller driving motor 27 uses carriage information generated by the carriage information generation unit 22*a* as a control pulse, to establish synchronization of the carrying speed of the recording medium 2 and the peripheral speed of the cutter blades 26.

While two cutter blades 26 are disposed here, the number does not need to be two.

Meanwhile, an encoder may be installed in the cut roller driving motor 27, and the synchronization of the carriage speed of the recording medium 2 and the peripheral speed of the cutter blades 26 may be realized by its encoder signal.

The introducing unit 9 is disposed between the carrying unit 7 and the cutting unit 8, and has a cutter feeding roller pair 28 that sandwiches and holds the recording medium 2 and introduces it into the cutting unit 8 at a tension that is smaller than the tension in the carrying unit 7. The cutter feeding roller pair 28 is driven by a cutter feeding roller driving motor 29.

The control unit 10 temporarily reduces the introducing amount of the recording medium 2 into the cutting unit 8 by temporality stopping the cutter feeding roller pair 28 or reducing its speed, to cut the recording medium 2 to a cut size that is shorter than the normal cut size. After that, the control unit 10 conducts a control to increase the introducing amount of the recording medium 2 into the cutting unit 8 by activating the cutter feeding roller pair 28 or increasing its speed at a predetermined timing, to cut the recording medium 2 to a cut size that is longer than the normal cut size.

Figure 5:
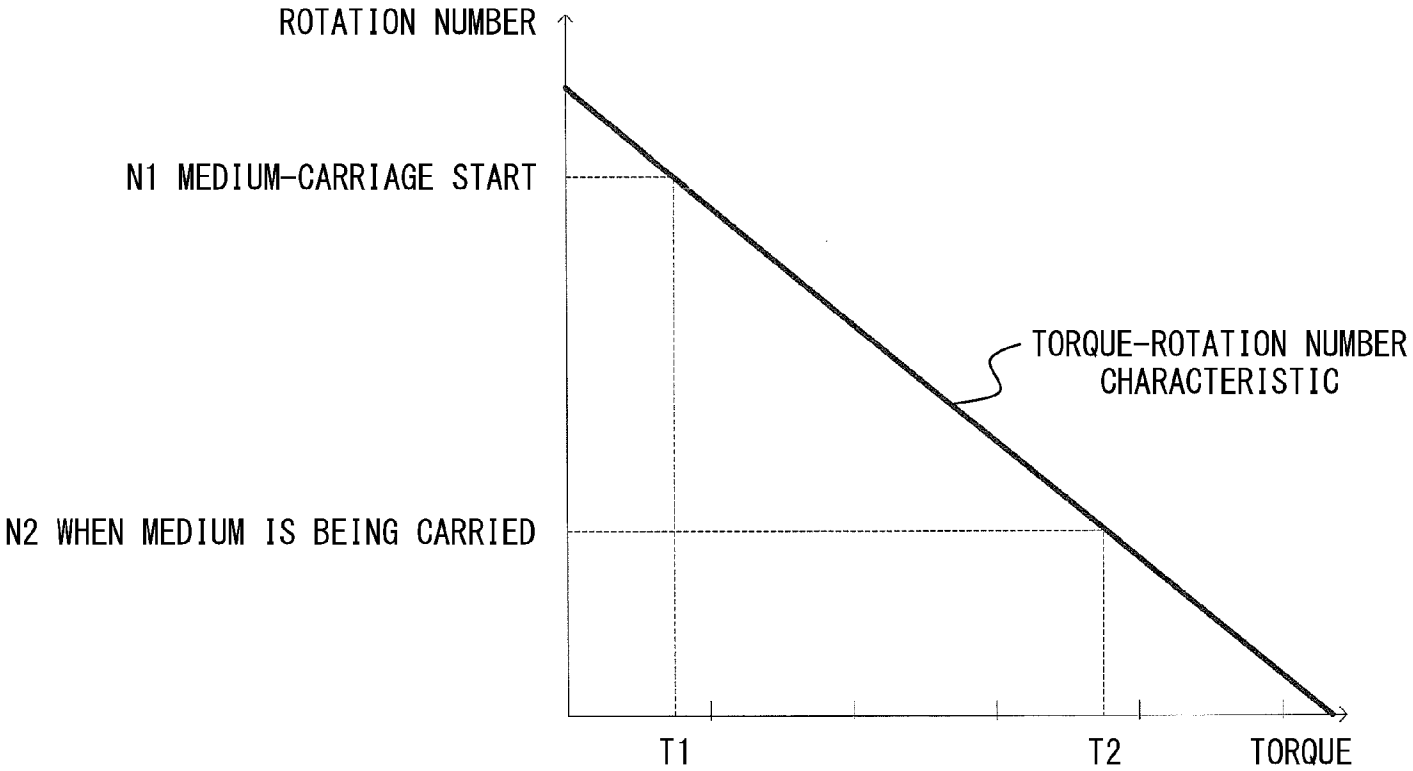
FIG. 5 is a diagram illustrating the torque-rotation number characteristic of the cutter feeding roller driving motor under constant-current driving.

FIG. 5 is a diagram illustrating the torque-rotation number characteristic of the cutter feeding roller driving motor 29 under constant-current driving. The driving method of the cutter feeding roller driving motor 29 is the constant-torque driving (or the constant-current driving), only flowing a constant current into the motor without any speed control. Therefore, a servo circuit is not required. However, the torque generates a lower tension than the tension generated by the carrying unit 7, and the characteristic is set so that a carrying speed that exceeds the normal carrying speed of the recording medium 2 can be obtained with the rotation speed under the unloaded condition.

For example, in FIG. 5, when the medium is being carried, the load is high (for example, a high torque T2) since there is a tension generated by the nip roller pair 20, and the rotation number of the cutter feeding roller driving motor 29 is a low rotation number (for example, N2). Meanwhile, at the time of the activation start after stopping the recording medium 2, the recording medium 2 is slack before the cutter feeding roller pair 28, and there is almost no load (for example a low torque T1). Therefore, the rotation number of the cutter feeding roller driving motor 29 becomes high (for example, N1), and the recording medium 2 is carried to the cutting unit 8 rapidly.

In the above configuration, the processing operation of the image recording apparatus 1 is described. Meanwhile, the control unit 10 receives an image recording order from a higher-level apparatus 23 such as a personal computer (PC) for example, and performs the driving control of the first image recording unit 5, the second image recording unit 6, the carrying unit 7, the cutting unit 8, and the introducing unit 9.

First, the recording medium 2 is installed on the recording medium feeding unit 3 as a winded roll as described above. The rolled recording medium 2 is provided with a back tension by a friction providing mechanism that is not illustrated in the drawing.

The nip roller pair 20 carries the recording medium 2 to the first image recording unit 5 while keeping the carrying speed of the recording medium 2 constant. Then, an image recording process is performed on the front surface of the recording medium 2 in the first image recording unit 5. The recording medium 2 is further carried, and an image recording process is performed on the back surface of the recording medium 2 in the second image recording unit 6.

In the present embodiment, a rotary-system cutting unit 8 is used as a measure for cutting the continuous medium to predetermined printing units. By controlling the peripheral speed of the cutter blades 26 so as to rotate them at a constant speed in synchronization with the carrying speed of the recording medium 2, the cutter blades 26 are pressed on the anvil roller 25 side, and cut the recording medium 2 to a predetermined size.

A blade position information generation unit 30 is disposed on the driving axis of the cut roller 24 for detecting the position of the cutter blade 26. The blade position information generation unit 30 consists of, for example, an absolute encoder. Then, if the installed position of the cutter blade 26 is assumed as the origin position of the absolute encoder, the outer-circumference length from the current position of the cutter blade 26 to the next cut position can be obtained from the total outer-circumference length of the cut roller 24 and the resolution of the absolute encoder.

Figure 6C:
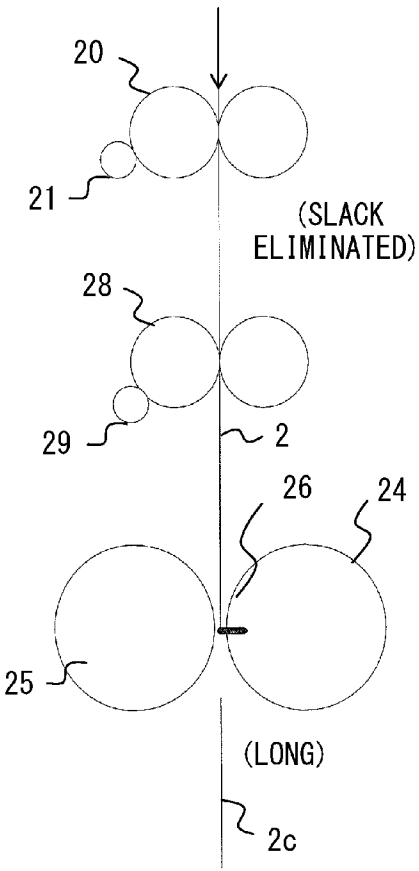
FIG. 6C is a diagram describing a control to cut the recording medium longer than a predetermined length.

The cut roller 24 and the anvil roller 25 have a greater inertial force compared to the nip roller pair 20, and are rotating at a predetermined constant speed. The recording medium 2 is cut by being inserted between the cut roller 24 and the anvil roller 25. At this time, as illustrated in FIG. 6A, the recording medium 2*a* is cut to the length of its movement during the period of time required for one rotation of the cut roller 24.

Meanwhile, when a job is completed and if the rotation stop or the speed-reduction control of the cutter feeding roller pair 28 is conducted for a predetermined period of time, the feeding amount of the recording medium 2 introduced to the cutting unit 8 during the time for the stop or speed reduction decreases, while the cut roller 24 and the anvil roller 25 still rotate at a constant speed during the period. As a result, as illustrated in FIG. 6B, the recording medium 2 is cut as a recording medium 2*b* that is shorter than the predetermined length, and output from the cutting unit 8.

Figure 6B:
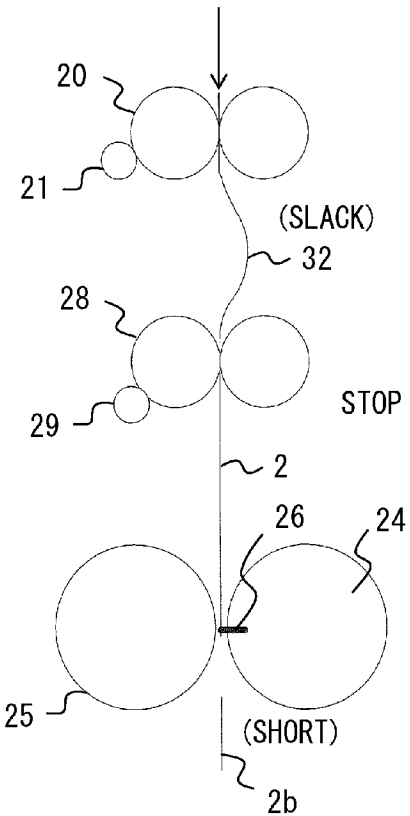
FIG. 6B is a diagram describing a control to cut the recording medium shorter than a predetermined length.
Figure 6A:
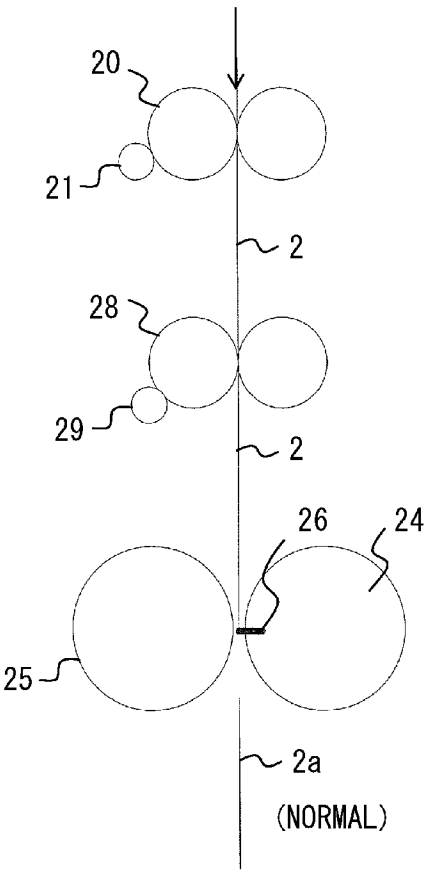
FIG. 6A is a diagram describing a control to cut the recording medium to a predetermined length.

Furthermore, the carrying process of the recording medium 2 by the nip roller pair 20 is continued during the period, and as a result, the recording medium 2 forms a curved slack part 32 between the nip roller pair 20 and the cutter feeding roller pair 28, as illustrated in FIG. 6B.

After that, when the stop or speed reduction of the cutter feeding roller pair 28 is cancelled, the curved and slack recording medium 2 enters a state with no influence from the nip roller pair 20, and the load for the cutter feeding roller driving motor 29 temporarily becomes very light. For this reason, the cutter feeding roller driving motor 29 rotates at a high speed in accordance with the torque-rotation number characteristic illustrated in FIG. 5 until the slack of the recording medium 2 is eliminated. Therefore, the cutter feeding roller pair 28 feeds the recording medium 2 to the cutting unit 8 side, with the amount of the fed recording medium 2 being longer by the length corresponding to the slack part 32.

As a result, as illustrated in FIG. 6C, the recording medium 2 is cut as a recording medium 2*c* that is longer than the predetermined length and output from the cutting unit 8.

Figure 7:
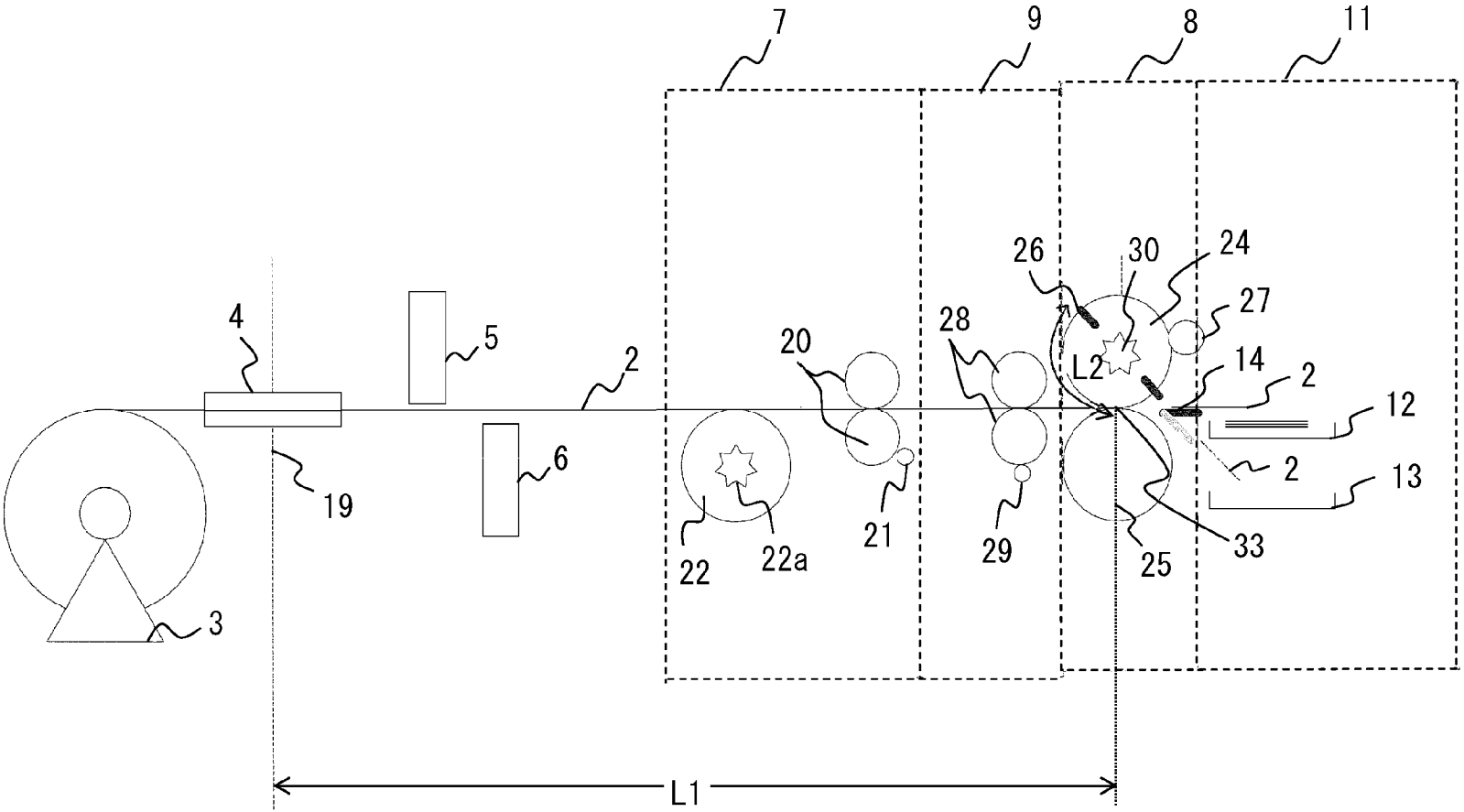
FIG. 7 is a section diagram illustrating the format of the image recording apparatus, which particularly illustrates the carrying path length of the recording medium.

FIG. 7 is a section diagram illustrating the format of the image recording apparatus 1 as well as FIG. 2, and particularly illustrates the carrying path length of the recording medium 2. The carrying path length from the recording medium connecting position in the recording medium connecting unit 4 to the actual cut position is the total of a length L1 from the position of the recording medium cutting slit 19 in the recording medium connecting unit 4 to the cutter contact position and an outer-circumference length L2 from the stop position of the cutter blade 26 to the cutter contact position. The outer-circumference length L2 changes depending on the condition at the time when the carriage is stopped.

Here, when the carrying path length (L1−L2) equals to an integral multiple of a predetermined cut length Lc of the recording medium 2, it can be determined that the recording medium connecting position and the cut position are at the same position. Considering that the carrying path length L1 is a fixed value that depends on the carrying path, when the division of L1 by the cut length Lc leaves a remainder length that is the same value as the outer-circumference length L2 of the stop position of the cutter blade 26, it can be determined that the recording medium connecting position and the cut position are at the same position.

Furthermore, when considering the width Lt of a tape attached in the vicinity of the recording medium connecting position, when the remainder value of the above operation falls within the range of ±Lt, it can be determined that the recording medium connecting position of the recording medium 2 comes in the vicinity of the cut position.

Figures 8A, 8B:
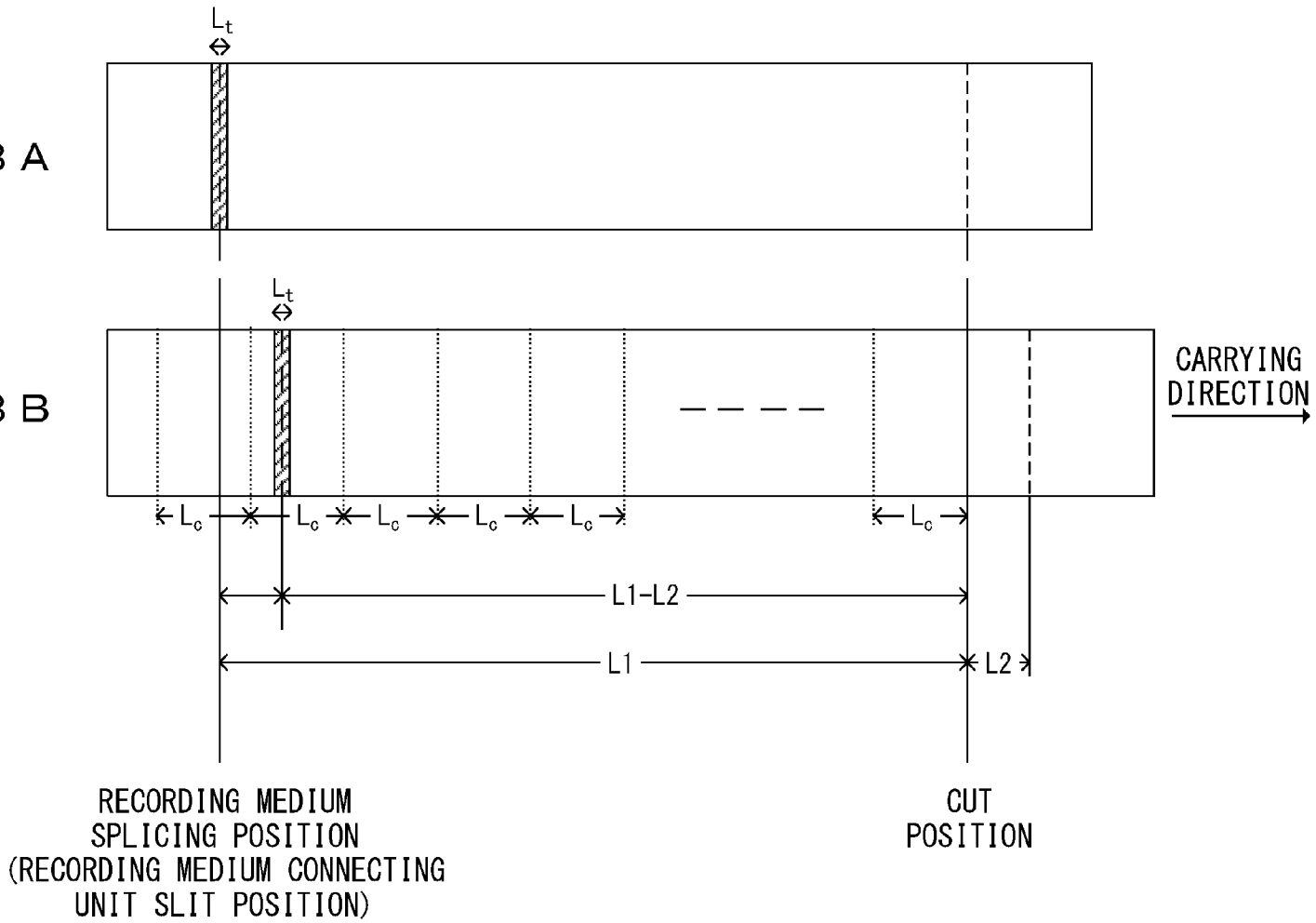
FIGS. 8A and 8B are a diagram illustrating a case in which the recording medium connecting position of the recording medium is on a position that is not cut by the cutter blade.
Figures 9A, 9B:
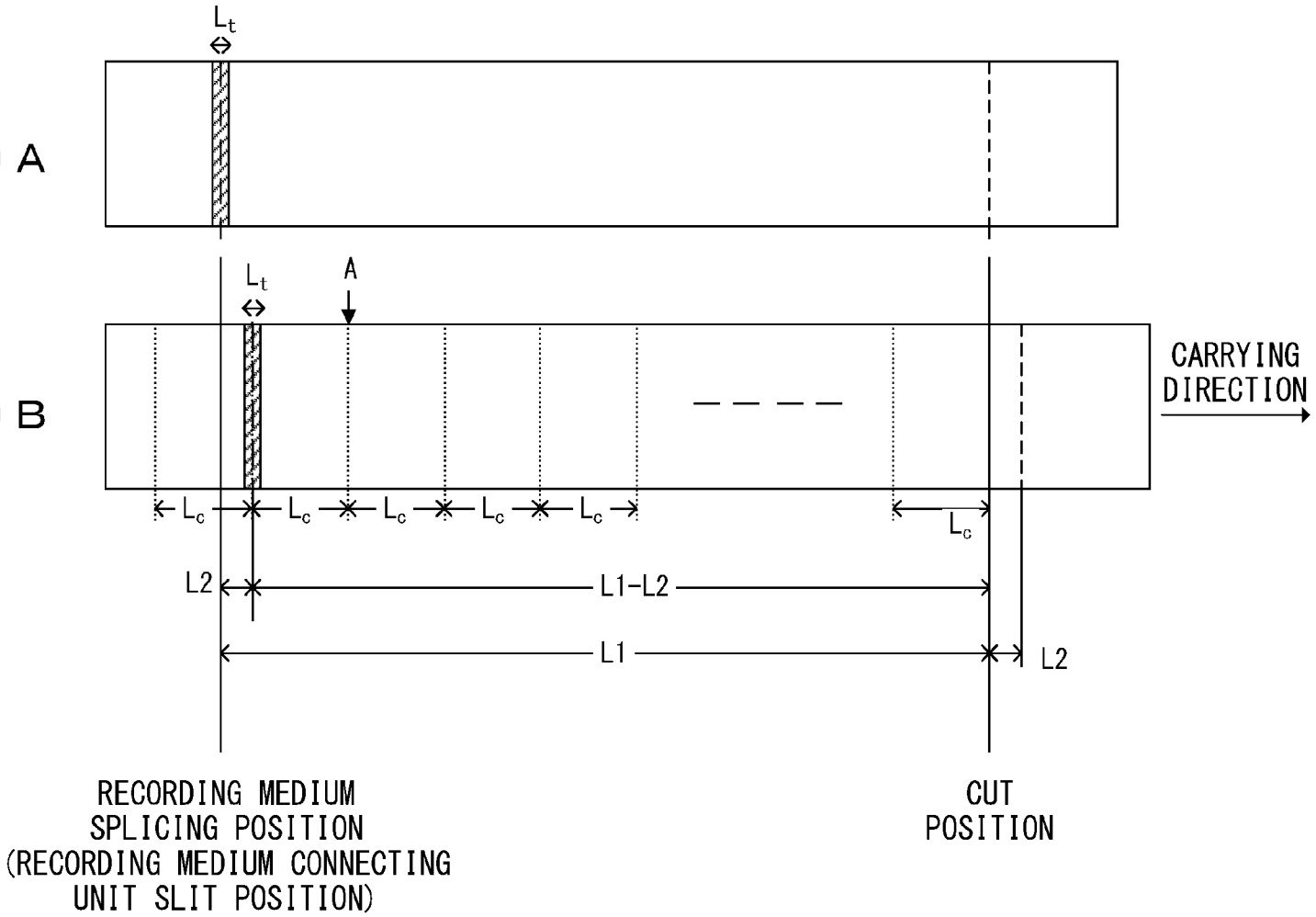
FIGS. 9A and 9B are a diagram illustrating a case in which the recording medium connecting position of the recording medium is on a position that is cut by the cutter blade.

FIGS. 8A and 8B are a diagram illustrating a case in which the recording medium connecting position of the recording medium 2 is on a position that is not cut by the cutter blade 26. FIG. 8A illustrates the state in which the connected recording medium is stopped, and FIG. 8B illustrates the cut state. FIGS. 9A and 9B are a diagram illustrating a case in which the recording medium connecting position of the recording medium 2 is on a position that is cut by the cutter blade 26. FIG. 9A illustrates the state in which the connected recording medium is stopped, and FIG. 9B illustrates the cut state.

Figure 10:
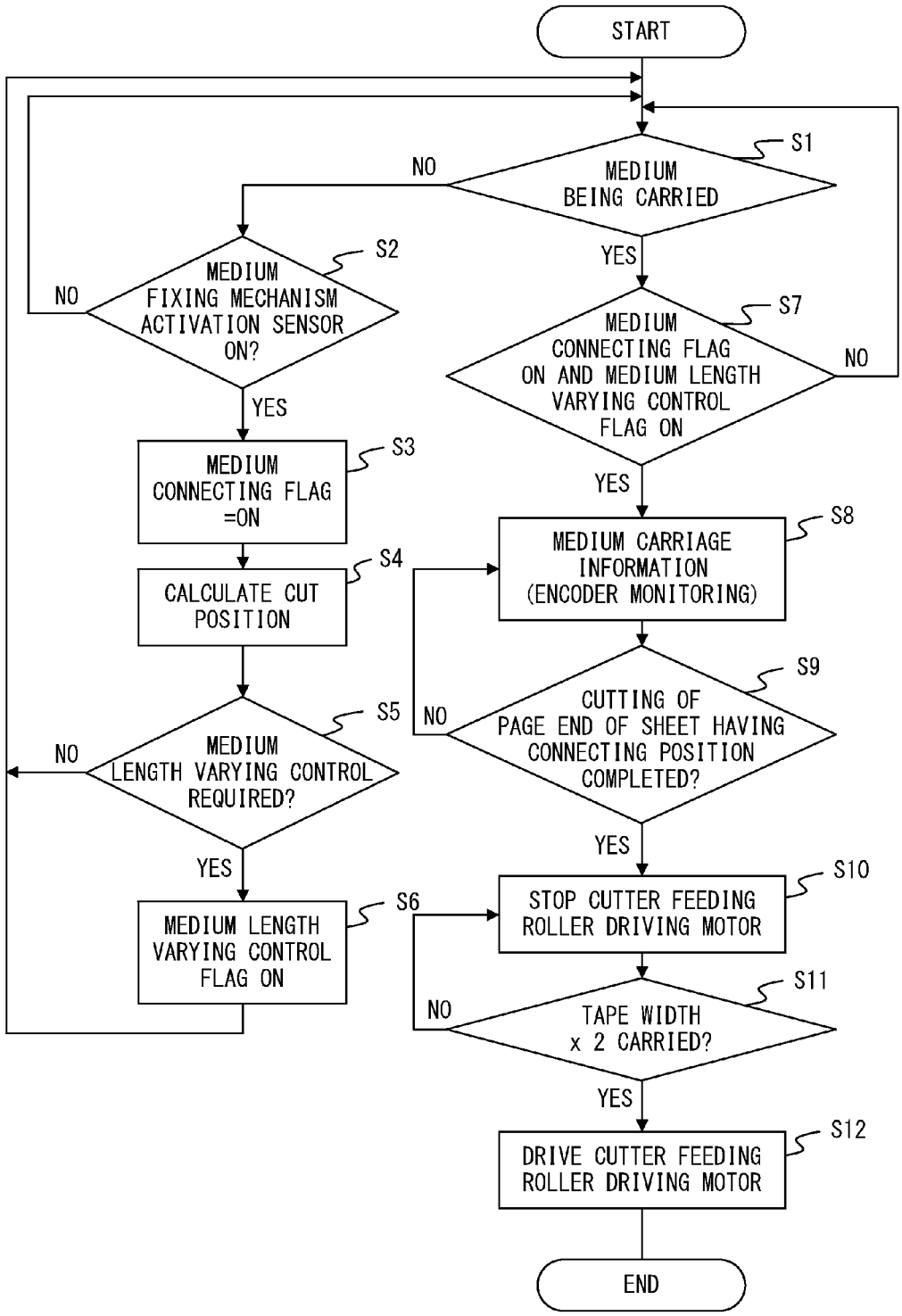
FIG. 10 is a flowchart describing the processes in the embodiment.

Hereinafter, the processes in the present example are described in accordance with the flowchart illustrated in FIG. 10.

First, the control unit 10 determines whether or not the recording medium 2 is being carried on the carrying path or not (step (hereinafter, referred to as (S1). Here, if the recording medium 2 is not being carried on the carrying path (NO in S1), whether or not the recording medium fixing mechanism activation sensor 18 is on or not is determined (S2). As described above, the recording medium fixing mechanism activation sensor 18 is a sensor which turns on when the first recording medium fixing mechanism 16 for connecting the recording medium 2 is activated, and is disposed in the recording medium mounting plate 15.

Therefore, when the connecting operation of the recording medium 2 is not performed (NO in S2), the process returns to the determination as to whether or not the medium is being carried (S1). On the other hand, when the connection operation of the recording medium 2 is performed (YES in S2), a medium connecting flag that is an internal control flag in the control unit 10 is set to on (S3), and the cut position length of the recording medium 2 is calculated from the known L1, the outer-circumference length L2 from the cutter stop position to the cutter contact position, and the predetermined cut length Lc (S4).

According to the calculation, as described above, the carrying path length from the recording medium connecting position in the recording medium connecting unit 4 to the actual cut position is calculated, and when the carrying path length (L1–L2) does not equal to an integral multiple of the predetermined cut length Lc of the recording medium 2, it is determined that the recording medium connecting position and the cut position are not on the same position (NO in S5). In this case, the process returns to the determination as to whether or not the medium is being carried (S1).

Meanwhile, when the carrying path length (L1–L2) is an integral multiple of the predetermined cut length Lc, it is determined that the recording medium connecting position and the cut position are on the same position (YES in S5). In this case, the control unit 10 determines that the variable length control of the recording medium 2 is required when the recording medium 2 is carried next time, and sets a medium length varying control flag to on (S6).

After that, the control unit 10 determines whether or not the carrying process of the recording medium 2 is being performed or not (S1). Then, when a printing order is issued from the higher-level apparatus 23 and the carriage of the recording medium 2 is performed (YES in S1), the control unit 10 determines whether or not the medium connecting flag and the medium length varying control flag are on (S7). In other words, the control unit 10 determines whether both the medium connecting flag and the medium length varying control flag have been set in the processes (S3, S6) mentioned above.

Here, if the setting of both flags has not been performed (NO in S7), the process returns to the first determination (S1). On the other hand, if the setting of both flags has been performed (YES in S7), the medium carriage information is monitored (S8). In other words, in order to find how much the recording medium connecting position has been carried, the information output from the carriage information generation unit 22*a* is monitored.

After that, the control unit 10 determines whether or not the page end (part A in FIG. 9B) of the sheet having the recording medium connecting position has reached the cut position (S9). The carriage of the recording medium 2 is continued by the carrying unit 7, and when it is determined that the page end of the sheet having the recording medium connecting position has reached the cut position (YES in FIGS. 9A and 9B), the driving of the cutter feeding roller driving motor 29 is stopped in order to change the cut length of the medium (S10). Then, the carriage information from the carriage information generation unit 22*a* is monitored, and whether or not the carriage of the medium for a prescribed length (for example, twice the tape width Lt) has been completed is determined (S11). During this process, the recording medium 2 becomes slack as illustrated above in FIG. 6B, forming the slack part 32.

The reason for adding the prescribed length is for avoiding the cutter blade 26 cutting the tape attached on the recording medium connecting position, and when it is determined that the recording medium 2 has been carried for the prescribed length (YES in S11), the driving of the cutter feeding roller driving motor 29 is resumed (S12).

With the configuration described above, the rotation of the cutter feeding roller pair 20 is resumed, and the slack part 32 of the recording medium 2 is carried to the cutting unit 8 immediately by the rotation of the cutter feeding roller pair 20, and the recording medium 2 is cut by the cutter blades 26 with the rotation of the cut roller 24.

Figure 11A:
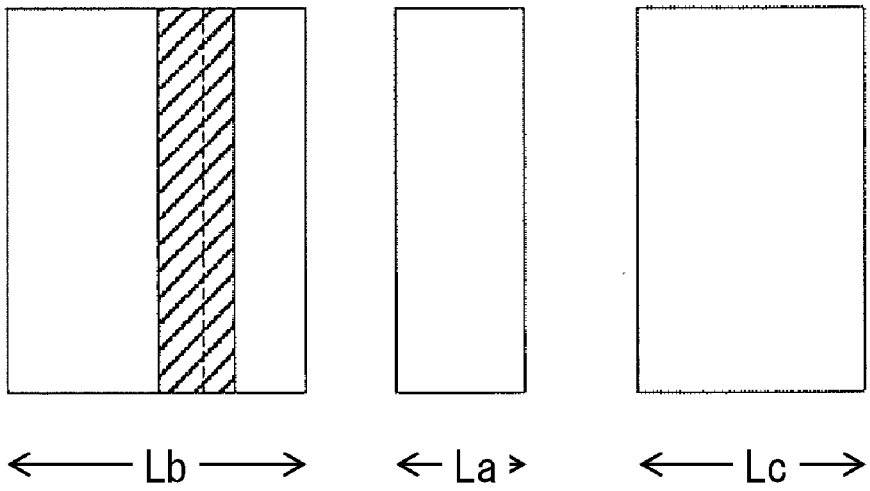
FIG. 11A is a diagram illustrating the cut position of the recording medium.
Figure 11B:
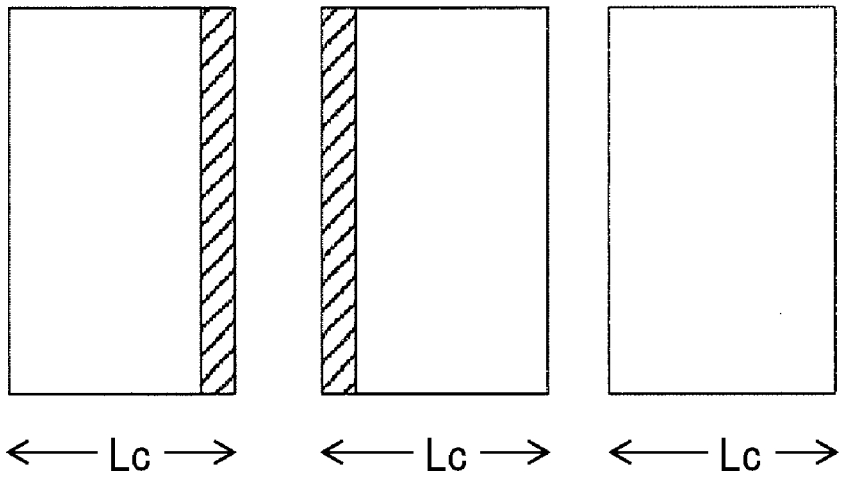
FIG. 11B is a diagram illustrating a case in which a tape adhered on the recording medium connecting position is cut.

In this case, as illustrated in FIG. 11A, after the recording medium 2 in the predetermined length Lc is output from the cutting unit 8, the recording medium 2 in a length La that is shorter than the predetermined length is output from the cutting unit 8 first, and next, the recording medium 2 in a length Lb that is longer than the predetermined length is output from the cutting unit 8. Meanwhile, FIG. 11B illustrates a comparison with the present example, and shows that when the control in the present example is not performed, the tape attached on the recording medium connection position may be cut.

Therefore, according to the image recording apparatus 1 in the present embodiment, without using any special recording-medium connecting-position control mechanism, and even when a user adds a recording medium constantly at the same position, the recording medium connecting position can be moved away from the cut position automatically, to avoid reduction of the life of the cutter and the jamming of the recording medium 2.

In other words, the present invention provides an image recording apparatus and a control method of an image recording apparatus that are capable of extending the life of the cutter and avoiding the jamming of the recording medium by controlling the cut position so that it does not fall on the connecting position of the continuous recording medium, without using any special recording-medium connecting-position control mechanism and even when a continuous recording media are connected constantly at the same position.

Meanwhile, while constant-torque driving is adopted for the cutter feeding roller driving motor 29 driving the cutter feeding roller pair 28 in the present embodiment, if a predetermined characteristic can be obtained at the rotation number under the unloaded condition and the torque of the motor, constant-voltage driving may be performed.

In addition, while the cut position of the recording medium 2 is adjusted by stopping or reducing the speed of the driving of the cutter feeding roller pair 28 in the description of the above embodiment, the configuration may be made so as to adjust the rotation speed of the cut roller 24 by controlling the driving of the cut roller driving motor 27.

In addition, while the explanation has been made using an example of a rotary cutter for the embodiment of the present invention, the cutter unit is not limited to the rotary cutter, and may be a guillotine-type cutter or a laser-type cutter.

Furthermore, the present invention is not limited to the embodiment described above, and at the implementation stage, the present invention can be realized while altering the elements without deviating from the scope of the present invention. In addition, the present invention enables various inventions by the combination of the plurality of elements that are described in the above embodiment as needed. For example, in the present invention, several elements may be deleted from the entire elements described in the embodiment, and further, different elements in the embodiments may be combined as needed.

What is claimed is:

1. An image recording apparatus comprising:

a carrying unit carrying a continuous recording medium and having a carriage information generation unit which generates carriage information of the continuous recording medium;

a recording medium connecting unit for replacing and connecting the continuous recording medium;

a cutting unit having a cutter which cuts the continuous recording medium and a detector which detects a cutting position of the cutter;

an introducing unit disposed between the carrying unit and the cutting unit, and having a pair of introducing rotating bodies nipping the continuous recording medium to hold and introduce the continuous recording medium into the cutting unit; and a control unit determining whether a connecting position of the continuous recording medium connected in the recording medium connecting unit corresponds to the cutting position of the cutting unit based on an output from the carriage information generation unit, and when the connecting position and the cutting position are determined as corresponding, controlling a cutting length of the continuous recording medium having the connecting position, to avoid cutting being conducted at the connecting position.

2. The image recording apparatus according to claim 1, wherein:

the cutter of the cutting unit has a cutting-side rotating body and a receiving-side rotating body disposed facing each other so as to be able to cut the continuous recording medium and rotating at a constant rotation number;

and the control unit temporarily reduces an introducing amount of the continuous recording medium into the cutting unit by temporarily stopping the pair of introducing rotating bodies or reducing a speed of the pair of introducing rotating bodies, to introduce the continuous recording medium in a shorter cut length than a normal cut length, and after that, increases the introducing amount of the continuous recording medium into the cutting unit at a predetermined timing by activating the introducing rotating bodies or increasing the speed of the introducing rotating bodies, to introduce the continuous recording medium in a longer length than the normal cut length.

3. The image recording apparatus according to claim 1, wherein the recording medium connecting unit has a cutting slit disposed at a predetermined position for cutting the continuous recording medium, and in the determining of whether the connecting position of the continuous recording medium corresponds to the cutting position by the control unit, the position of the cutting slit is calculated as the connecting position.

4. The image recording apparatus according to claim 3, wherein when a tape is used for connecting the continuous recording medium, in the determining of whether the connecting position of the continuous recording medium corresponds to the cutting position by the control unit, a range in which the tape exists anteriorly and posteriorly to the position of the cutting slit is taken as the connecting position.

5. The image recording apparatus according to claim 1, wherein the cutter of the cutting unit comprises a cutting blade provided on an outer circumference of a rotating body, and assuming an outer-circumference moving length of the cutting blade from a stop position of the cutting blade to the cutting position as L2, a carrying length from the recording medium connecting position to the cutting position as L1, and a normal cutting length of the continuous recording medium as Lc, when a carrying path length (L1−L2) equals to an integral multiple of the Lc, the control unit determines that the recording medium connecting position and the cutting position are at a same position.

6. The image recording apparatus according to claim 2, wherein assuming a cut length introduced and cut in a shorter cut length than the normal cut length as La, a cut length introduced and cut in a longer cut length than the normal cut length as Lb, and the normal cutting length as Lc, La+Lb=2Lc.

7. A control method of an image recording apparatus, the image recording apparatus comprising a carrying unit carrying a continuous recording medium and having a carriage information generation unit which generates carriage information of the continuous recording medium; a recording medium connecting unit for replacing and connecting the continuous recording medium; a cutting unit having a cutter which cuts the continuous recording medium and a detector which detects a cutting position of the cutter; and an introducing unit disposed between the carrying unit and the cutting unit, and having a pair of introducing rotating bodies nipping the continuous recording medium to hold and introduce the continuous recording medium into the cutting unit, the control method comprising:

determining whether a connecting position of the continuous recording medium connected in the recording medium connecting unit corresponds to the cutting position of the cutting unit based on an output from the carriage information generation unit, and when the connecting position and the cutting position are determined as corresponding, performing a control of a cutting length of the continuous recording medium having the connecting position, to avoid cutting being conducted at the connecting position.

8. The control method according to claim 7, wherein:

the cutter of the cutting unit has a cutting-side rotating body and a receiving-side rotating body disposed facing each other so as to be able to cut the continuous recording medium and rotating at a constant rotation number;

the control to avoid cutting being performed at the connecting position temporarily reduces an introducing amount of the continuous recording medium into the cutting unit by temporarily stopping the pair of introducing rotating bodies or reducing a speed of the pair of introducing rotating bodies, to introduce the continuous recording medium in a shorter cut length than a normal cut length, and after that, increases the introducing amount of the continuous recording medium into the cutting unit at a predetermined timing by activating the introducing rotating bodies or increasing the speed of the introducing rotating bodies, to introduce the continuous recording medium in a longer length than the normal cut length.

9. The control method according to claim 7, wherein when a tape is used for connecting the continuous recording medium, in the determining of whether the connecting position of the continuous recording medium corresponds to the cutting position by the control unit, a range in which the tape exists is taken as the connecting position.

10. The control method according to claim 7, wherein the cutter of the cutting unit comprises a cutting blade provided on an outer circumference of a rotating body, and assuming an outer-circumference moving length of the cutting blade from a stop position of the cutting blade to the cutting position as L2, a carrying length from the recording medium connecting position to the cutting position as L1, and a normal cutting length of the continuous recording medium as Lc, when a carrying path length (L1–L2) equals to an integral multiple of the Lc, the control unit determines that the recording medium connecting position and the cutting position are at a same position.

11. The control method according to claim 8, wherein a sum of a cut length introduced and cut in a shorter cut length than the normal cut length and a cut length introduced and cut in a longer cut length than the normal cut length is approximately twice the normal cutting length.

* * * * *